United States Patent [19]

Peterson et al.

[11] 4,078,341

[45] Mar. 14, 1978

[54] PORTABLE BUILDING

[76] Inventors: Emmett G. Peterson, 5319 Maltby Rd., Woodinville, Wash. 98072; Robert E. Peterson, 14320 Edgewater La. NE., Seattle, Wash. 98125

[21] Appl. No.: 706,906

[22] Filed: Jul. 19, 1976

[51] Int. Cl.[2] ..... E04B 7/16

[52] U.S. Cl. ..... 52/71; 52/90; 52/584

[58] Field of Search ..... 52/93, 94, 71, 70, 90, 52/579, 580, 582, 584

[56] References Cited

U.S. PATENT DOCUMENTS

| | | | |
|---|---|---|---|
| 2,053,135 | 9/1936 | Dalton | 52/584 |
| 2,858,916 | 11/1958 | Josephs | 52/90 |
| 3,774,356 | 11/1973 | Philp | 52/70 |

FOREIGN PATENT DOCUMENTS

| | | | |
|---|---|---|---|
| 1,199,436 | 12/1959 | France | 52/584 |

*Primary Examiner*—John E. Murtagh
*Attorney, Agent, or Firm*—Dowrey & Cross

[57] ABSTRACT

A portable building comprised of one or more foldable, prefabricated transverse sections which, when erected and placed end to end, form the side walls and roof of the building. Channel members extending along the edges of the transverse sections are positioned and connected face to face by protruding U-shaped brackets. The backs of the channel members engage and position appropriate insulating panels or layers of varying thicknesses. Prefabricated end panels form the end walls of the building and are connected thereto by brackets generally similar to those used to connect adjacent transverse sections.

9 Claims, 10 Drawing Figures

FIG. 2
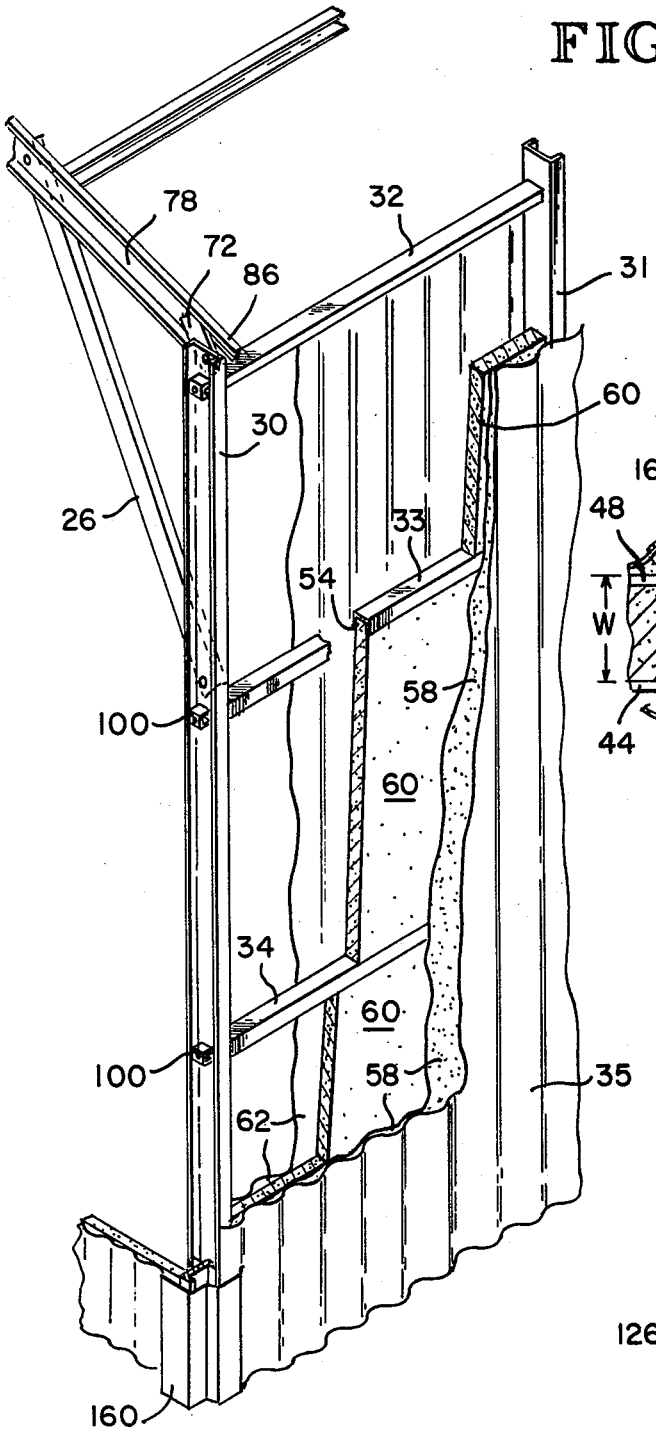
FIG. 3
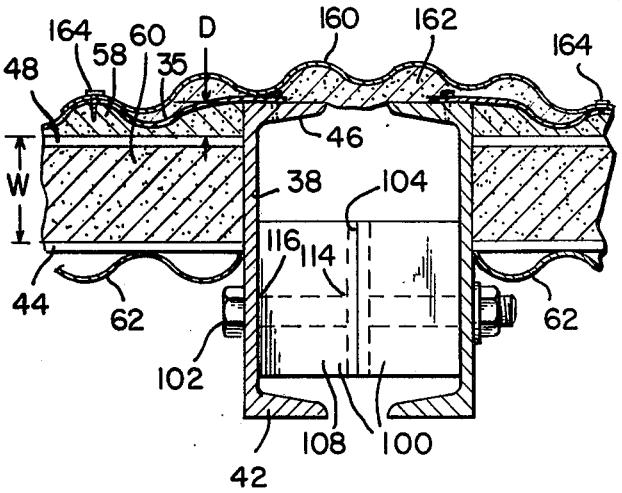
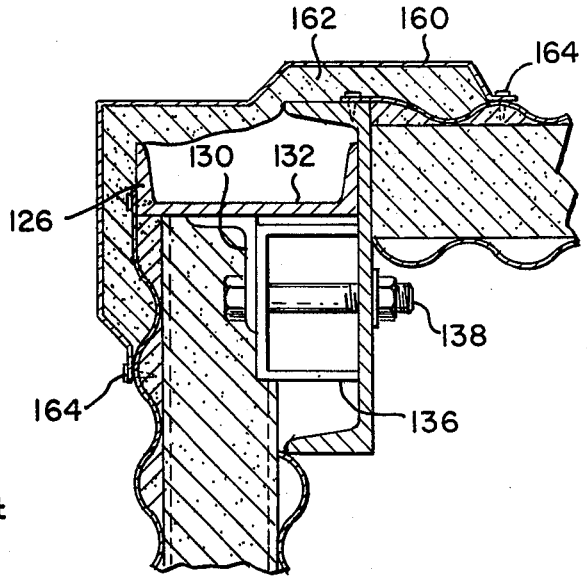
FIG. 4

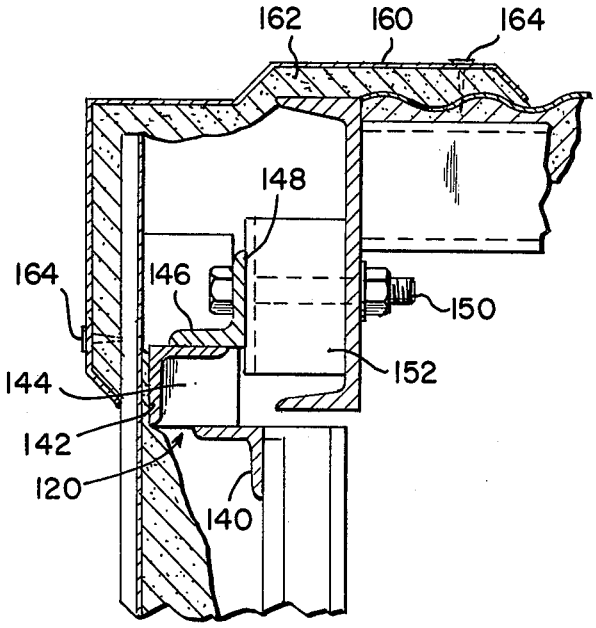
FIG. 5
FIG. 6
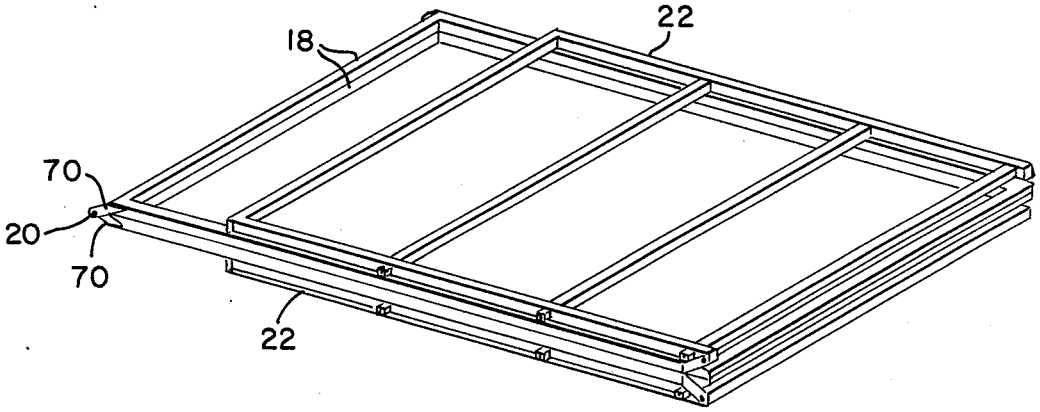
FIG. 7
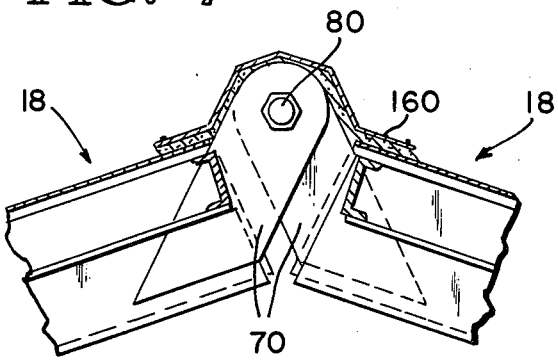
FIG. 8
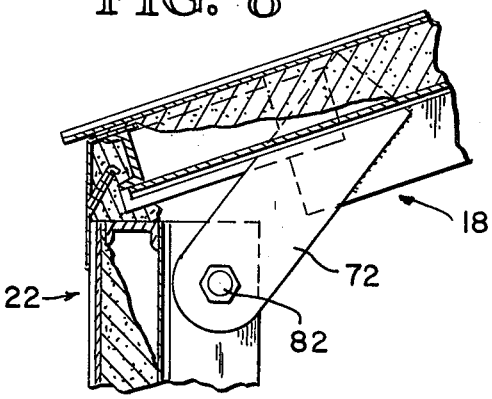

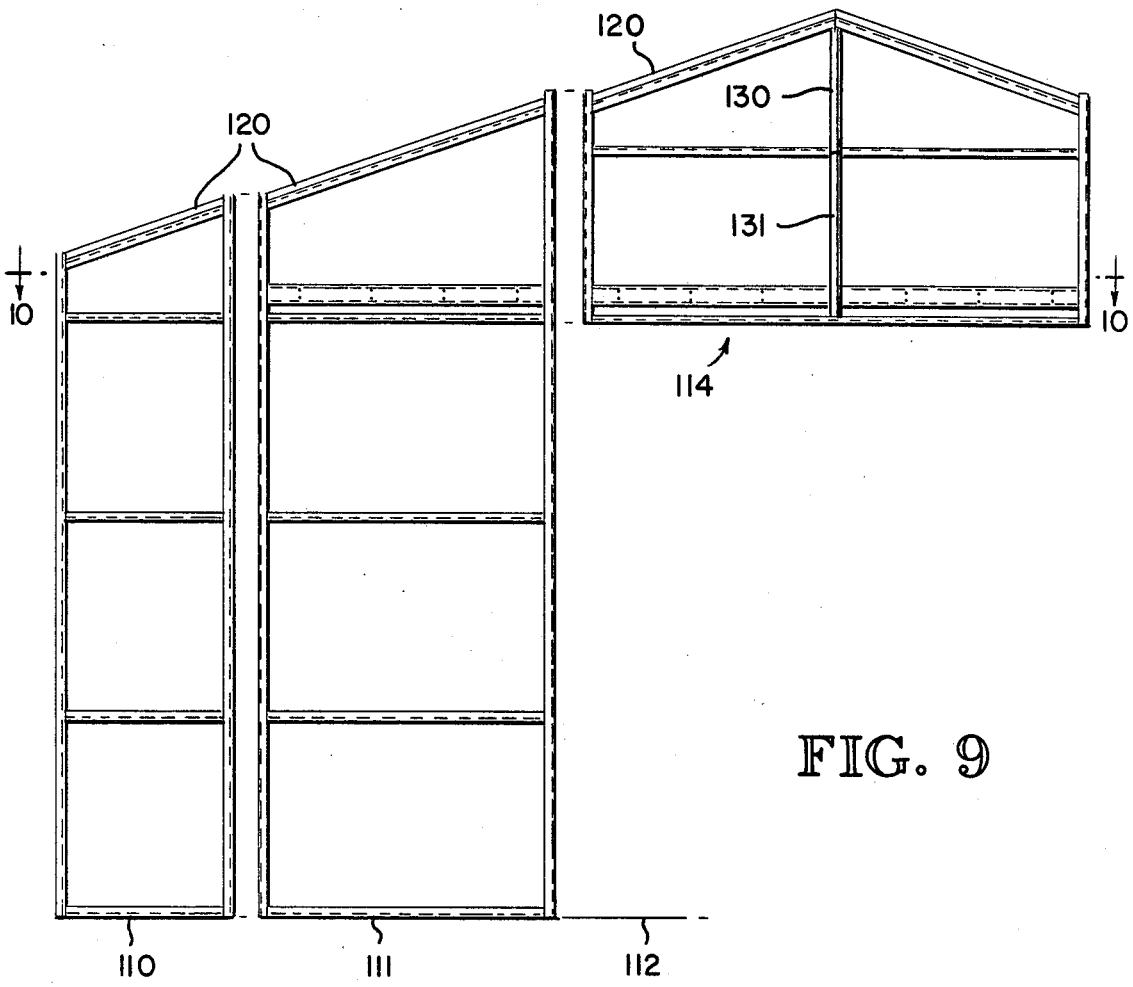
FIG. 9
FIG. 10
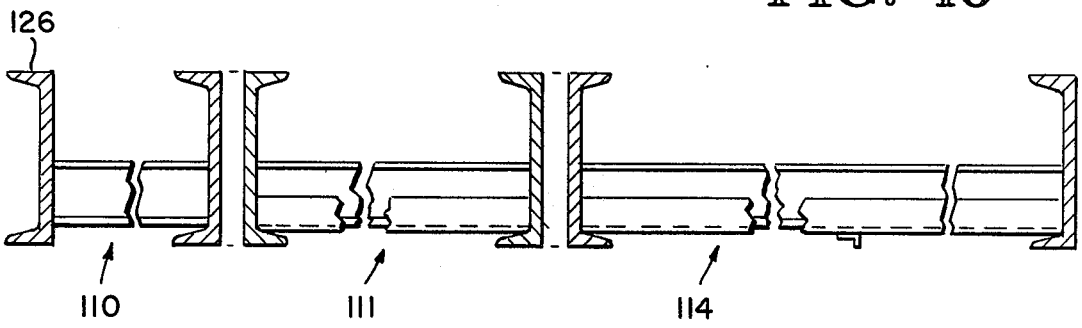

PORTABLE BUILDING

BACKGROUND OF THE INVENTION

1. Field of the Invention

The invention relates to portable buildings and, more particularly, to portable buildings made up of foldable, prefabricated transverse sections adapted to be shipped in folded condition to a building site.

2. Description of the Prior Art

Economic portable building designs heretofore proposed typically are tailored to specific applications and hence, often lack versatility. Prior building designs of this type, such as those disclosed in U.S. Pat. Nos.: to Philp, 3,296,752 and 3,774,356; Joseph, 2,858,916 and Harvey, 414,976 for example, sacrifice thermal insulation, structure stability, durability and other factors associated with prolonged usage or severe environmental conditions to achieve weight savings, enhanced portability, minimum assembly and disassembly effort, or other factors associated with temporary knock-down buildings. The building structure disclosed in the Philp U.S. Pat. No. 3,296,752, for example, requires uneconomical field assembly of the end walls, and preparation of a foundation. The latter structure additionally is provided with a fixed thickness of insulation material, the thickness being limited by the width of the channel members used and the back-to-back connection between vertical channel members of adjacent transverse sections.

SUMMARY OF THE INVENTION

This invention successfully overcomes these and other problems of prior buildings of the type under consideration by providing a portable building structure of foldable, prefabricated construction readily adapted to a wide variety of transportation, installation and environmental conditions. According to one preferred embodiment of the invention, the building structure is made up of one or more prefabricated, open-ended, transverse sections which, when positioned and connected end to end, yield a composite, free standing, open-ended building structure. Prefabricated end walls are secured to and close one or both ends of the composite building structure. To adapt the building structure to varying environmental conditions, the transverse sections and end walls provide mountings for various combinations of insulating panels or sheets of varying thicknesses. Channel members extending along the edges of the side and roof panels of adjacent transverse sections are positioned and connected face to face. The backs of these members engage and position appropriate insulating panels or layers of varying thicknesses. Brackets protruding from the channel members provide connection surfaces which may be bolted or otherwise secured together. The end wall or walls are connected to adjacent side wall or roof panels by similar means.

These and other features, objects, and advantages of the invention will be apparent from the detailed description and claims to follow taken in conjunction with the accompanying drawings.

BRIEF DESCRIPTION OF THE DRAWINGS

FIG. 2 is a fragmentary perspective view in expanded scale with parts broken away of the corner of one FIG. 1 transverse section;

FIG. 3 is a horizontal section of adjacent portions of the two FIG. 1 transverse sections when positioned and connected end-to-end;

FIG. 4 is a section taken along the line 4—4 of FIG. 1;

FIG. 5 is a section taken along the line 5—5 of FIG. 1;

FIG. 6 is a perspective of a single FIG. 1 transverse section folded;

FIG. 7 is a vertical section of the roof apex portion of one FIG. 1 transverse section;

FIG. 8 is a vertical section of adjacent portions of a side panel and a roof panel of one FIG. 1 transverse section;

FIG. 9 is an end elevational view with parts broken away of a FIG. 1 end wall;

FIG. 10 is a section taken along the line 10—10 of FIG. 9.

DETAILED DESCRIPTION OF THE DRAWINGS

Figure 1:
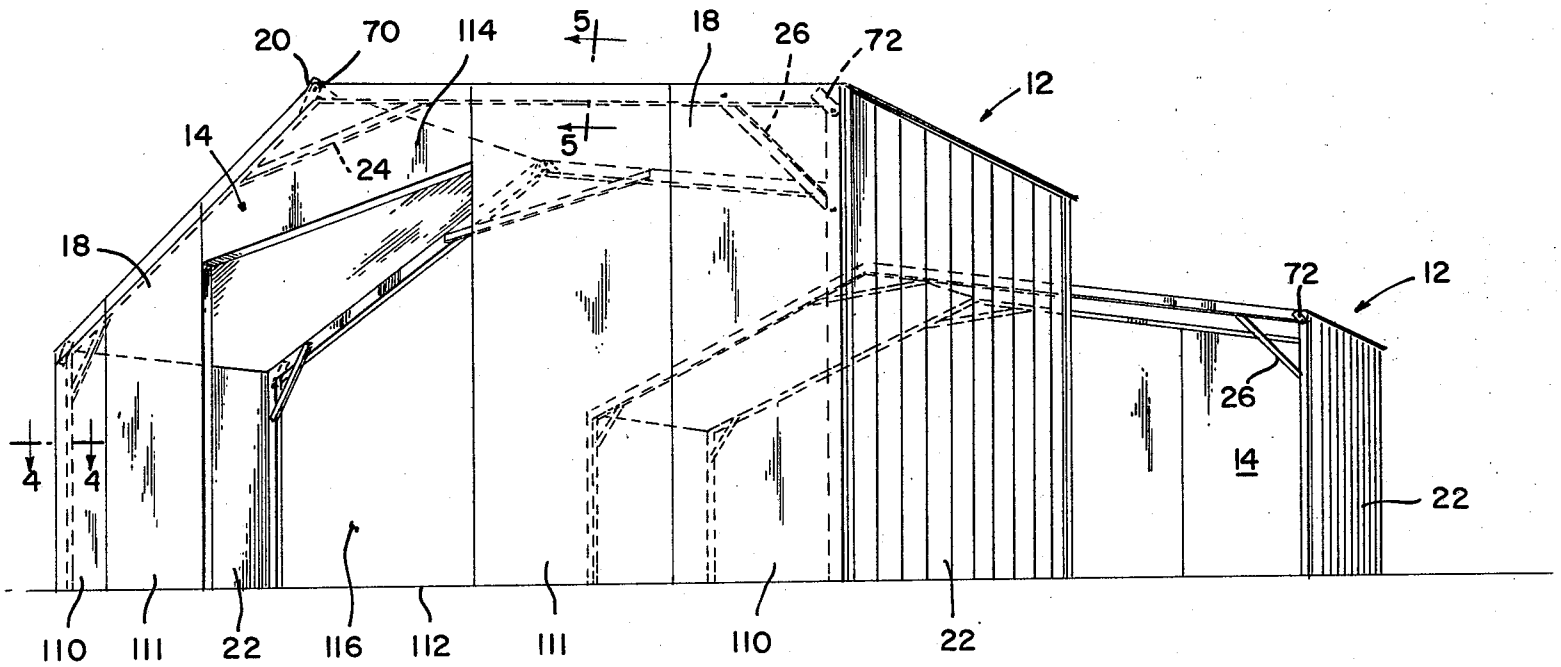
FIG. 1 is a perspective view of two spaced apart transverse sections with respective end walls of a building according to the present invention.

Referring to FIG. 1, the building structure of the present invention is comprised of one, two or more generally similar open ended transverse sections 12, which, when positioned and connected end to end, form a composite open ended building. End walls 14 with appropriate openings for windows and doors are secured to and close the ends of the building. The transverse sections and end walls constitute prefabricated units adapted for economical transportation, field installation and varying environmental conditions. Preferably, the load bearing and other exposed components of these units are fabricated of metallic material, although other materials could be used, if desired. Each transverse section is made up of a pair of rectangular, inwardly and upwardly converging roof panels 18, hingedly connected together along their line of convergence to form the apex 20 of the roof, and a pair of rectangular side panels 22, one side panel hingedly connected to and depending from the lower end of each roof panel. When the transverse section is erected as described below, the panels are held in rigid relationship to one another by means of roof braces 24 and corner braces 26. Suitable fastening means fasten adjacent sections and panels together into a complete building structure.

Referring now to FIG. 2, each side panel is preferably about ten feet wide and of a height corresponding to the desired height of the building sides. The FIG. 2 side panel is made up of a pair of spaced, vertical side members 30, 31, horizontal cross members 32, 33, 34 (lowermost cross member not shown) extending between the side members at evenly spaced intervals, and an outer covering sheet 35, preferably of corrugated material, extending between and fastened to the outside surfaces of the side members. Side members 30 and 31, and cross members 32, 33, 34 are constituted by generally similar elongated channel members which are generally U-shaped in cross section (see FIG. 3). Channel members of this type constitute the load bearing and support members of the illustrated building structure. In the example, the cross members are positioned face down (see channel 54) and the side members face away from one another. The widths of the cross members are smaller than and preferably less than about half the width of the side members. In addition to providing for flexibility in methods of insulation, as described below, the illustrated construction and arrangement of the cross and side members provide the side panels with much greater structural rigidity, particularly in response to torsional stresses, than prior art methods of construction.

The FIG. 2 panel construction may or may not be insulated, depending upon the application. As thus far described, it is uninsulated. To convert the FIG. 2 panel to a lightly insulated panel, a layer of insulating material 58 is positioned between the inside surface of sheet 35 and the cross members. To further insulate the building, a comparatively thick insulating panel 60 may be placed between each pair of the cross members in coplaner alignment therewith, the upper edge of panel 60 engaged with channel 54 of the upper cross member and the lower edge thereof resting on the back of the lower cross member, as shown (FIG. 2).

As will now be appreciated by referring to FIG. 3 (a horizontal cross section of two adjacent side members connected as will be described presently) each side member (side member designated 38 for reference purposes) faces away from the edges of panel 60 and layer 58 so that its back face provides a practical surface for positioning and constraining panel 60 and/or layer 58 depending upon the degree of insulation desired. In most practical cases, the distance D from the outer cross member flange (designated 48 for reference purposes, inner cross member flange likewise designated 44) to outer face of the side member flange 46 is appreciably smaller than the width W of the cross member web between flanges 44 and 48. Exemplary dimensions for D and W are 1 inch and 4 inches, respectively.

The roof panels 18 are comprised of side members, cross members, and covering sheets in an arrangement similar to that of the side panels described above. The roof panels may therefore be insulated in the same manner as the side panels. In addition, the roof panels include a pair of upper hinge plates 70 (FIG. 7) and a pair of lower hinge plates 72 (FIG. 8). Each hinge plate contains an opening therein to receive a hinge pin. Pairs of roof panels are joined together by hinge pins 80 passing through the openings in the upper hinge plates. The openings are located in the plane of the outer surface of the roof panel so that hingedly connected roof panels can be rotated until their outer surfaces lie flat against one another, as shown in FIG. 6.

Lower hinge plates 72 are secured to and extend longitudinally and downwardly from the lower end of the side member webs 78 (FIG. 2). Each lower hinge plate is off-set inwardly in relation to its web. Hinge pins 82 (FIG. 8) passing through the openings in the lower hinge plates and corresponding openings in the side member webs of the side panels hingedly secure the roof panels to the side panels. Hinge plates and web openings are located so that the side panels can be swung upwardly and inwardly to lie flat against the roof panels, as shown in FIG. 6. Preferably, eave structures 86 are fastened to and extend longitudinally from the lower ends of the roof panel side members.

As previously described, two roof panels and two side panels are hingedly joined together to form a transverse section 12. Such a section may be folded into a compact volume, as shown in FIG. 6, to facilitate shipment of the building structure. When erected, the transverse section is made self-supporting by means of a roof brace 24 and corner braces 26. These braces are preferably elongated members having ends with opening therein to receive pins. These openings are aligned with openings in the webs of the side and roof panel side members, and the brace end portions are secured to the inner surfaces of such side members using pins.

Adjacent transverse sections are secured end to end by generally U-shaped brackets 100 located within the outward facing channels of the side members (see FIG. 2) and pins 102, as shown (FIG. 3). Each bracket comprises a flat plate 104 which is spaced from and secured parallel to the web 38 by means of two side plates 108. The flat plate is spaced from the web at a distance somewhat greater than the height of flanges 42, 46 so that the bracket protrudes beyond the channel formed by the web 38 and flanges 42, 46 for face to face engagement with the opposed face of its counterpart protruding from the adjacent channel, as shown (FIG. 3). An opening 114 in the flat plate 104 is aligned with a corresponding opening 116 in the web to allow passage of bolt or pin 102 therethrough. The roof panels are provided with generally similar brackets (not shown). The brackets are located at similar positions along the side members of corresponding side and roof panels so that when two transverse sections are placed end to end, their brackets and holes line up for reception of pins 102 to secure the brackets together in face to face relation. It will be recognized that the brackets may be secured together by other means.

The FIG. 1 end walls 14 are composed of panels 110, 111 and 114. Referring to FIG. 9, grounded end wall panels 110, 111 extend from the base line 112 of the building structure to the roof panel of the terminal transverse section. Suspended end wall panels 114 extend from such roof panels to a point between the roof panel and the base line, whereby a passageway 116 (FIG. 1) is formed beneath the suspended end wall panel. Panel 114 of course, could be replaced by a grounded panel, if desired.

With certain differences, the structure of the end wall panels is similar to that of the side and roof panels. Roof attachment structures 120, described in additional detail hereinafter, attach the end panels to the roof. The side members of each grounded end wall panel differ in height so that the slope of the roof attachment structure matches that of the roof panels. Vertical support members 130, 131 are provided in the suspended panel 114. As depicted in FIG. 10, all but two of the side members of the end wall panels have their channels facing each other, rather than outwards as in the side and roof panels. The two exceptions are the outermost side members of each end wall, whose channels face outwards. One such outward facing side members 126 is shown in FIGS. 4 and 10. Angle brackets 130 (FIG. 4) fastened to the web 132 of the outermost side members 126 secure the end walls to the side wall panels in combination with brackets 136 and pins 138. Brackets 136 are similar to the FIG. 3 brackets 100. Panels 110, 111 and 114 may be secured directly to one another by pins passing through aligned openings in their side member webs.

As shown in FIG. 5, the roof attachment structures (generally referenced by numeral 120 in FIG. 9) are generally similar. Each structure 120 is comprised of a first angle member 140, a second angle member 142, secured to the first angle member by parallel spaced apart support plates 144 (only one plate shown), and a third angle member 146, secured directly to the second angle member, as shown. Angle members 140, 142 and 146 are of elongated construction and extend the length of the upper edge of the respective end panel as shown (FIG. 9). The end of the member 140 is fastened to the respective end panel side members. The third angle member contains openings 148 through which pins 150 extend to secure the end wall panel to the roof panel via brackets 152. Brackets 152 also are similar to brackets 100 and 136 shown in FIGS. 3 and 4. Thus, it is possible, by utilizing similar brackets to connect the transverse sections, and mount the end panels, to achieve substantial economy through reduced fabrication costs and interchangeability of parts.

To erect each transverse section, the section is laid flat, as depicted in FIG. 6, adjacent the building site which may or may not include appropriate foundations. The side wall panels then are unfolded by swinging the upper side and roof panels about apex 20 in a counterclockwise direction, as illustrated, until they oppose and generally coincide with the planes of the lower panels. Apex 20 thereafter is lifted in a vertical direction until the roof panels assume a desired incline, at which time the relative positions thereof are fixed by installation of braces 24. Apex 20 thereafter is lifted to desired height, simultaneously swinging the side panels to upright positions. The relative positions of the roof and side panels are then fixed by installation of braces 26. The side, roof and end panels may be insulated either at this point, before the erection sequence is begun, or even before the building structure is shipped to the building site. Finally, flashing 160 and further insulating material 162 may be placed over the areas where panels are joined together (FIGS. 3, 4 and 5)and secured in place using screws 164, to provide further insulation and weatherproofing.

While the preferred embodiments of the invention have been illustrated and described herein, it should be understood that variations and alternatives will be apparent to one skilled in the art. Accordingly, the invention is not to be limited to the specific embodiments illustrated and described herein, and the scope and spirit of the invention are to be understood by reference to the following claims.

What is claimed is:

1. A building structure, comprising: a series of transverse sections aligned end to end to form the side walls and roof of the building structure, each transverse section including a pair of roof panels pivotally connected together to form a roof, a pair of side panels respectively connected pivotally to and depending from said roof panels, means for holding said roof panels in fixed angular relation with respect to each other and with respect to said side wall panels, outwardly facing channel members extending along the end edges of said side wall and roof panels, and means including a plurality of spaced apart brackets protruding from said channel members for connecting said transverse sections end to end, each said bracket terminating in a surface spaced outwardly from the face of the channel associated with the respective channel member a sufficient distance to engage a corresponding surface of a bracket associated with an adjacent transverse section in face to face relation.

2. The building structure of claim 1, wherein each said bracket is generally U-shaped.

3. The building structure of claim 1, further comprising insulating means extending between the unchanneled faces of said members, and means for retaining said insulating means in position.

4. The building structure of claim 1, further comprising second channel members of reduced width extending between the first-mentioned channel members, and insulating means intervening between the first-mentioned and second channel members and extending between the unchanneled faces of the first-mentioned channel members.

5. The building structure of claim 1, further comprising second channel members of reduced width extending between the first-mentioned channel members and spaced from one edge thereof, and insulating means extending between the unchanneled faces of the first-mentioned channel members adjacent the one edge thereof in engagement with said second channel members.

6. A building structure, comprising: at least one transverse section forming the side walls and roof of the building structure, said transverse section including a pair of roof panels pivotally connected together to form a roof, a pair of side wall panels respectively connected pivotally to and depending from said roof panels, means for holding said roof panels in fixed angular relation with respect to one another, means for holding said roof panels in fixed angular relation with respect to their respective depending side wall panels, outwardly facing channel members extending along the end edges of said side wall and roof panels, and means including a plurality of spaced apart brackets protruding from said channel members for connecting said transverse section with an adjacent transverse section in end to end relation, each said bracket terminating in a surface spaced outwardly from the face of the channel associated with the respective channel member a sufficient distance to engage a corresponding surface of a bracket associated with an adjacent transverse section in face to face relation.

7. A building structure, comprising: a series of transverse sections aligned end to end to form the side walls and roof of the building structure, each transverse section including a pair of roof panels pivotally connected together to form a roof, a pair of side wall panels, means for holding said roof panels in fixed angular relation with respect to each other and with respect to said side wall panels, outwardly facing channel members extending along the end edges of said side wall and roof panels, means protruding from said channel members for connecting said transverse sections end to end, means forming an end wall, and means protruding from the channel members of an overlying roof panel for connecting said end wall thereto, said means for connecting said end wall including a plurality of spaced apart brackets protruding from the channel member of the overlying roof panel, and means for securing said end wall to said brackets.

8. A building structure, comprising: a series of transverse sections aligned end to end to form the side walls and roof of the building structure, each transverse section including a pair of roof panels pivotally connected together to form a roof, a pair of side wall panels respectively connected pivotally to and depending from said roof panels, means for holding said roof panels in fixed angular relation with respect to each other and with respect to said side wall panels, outwardly facing channel members extending along the end edges of said side wall and roof panels, means protruding from said channel members for connecting said transverse sections end to end, means forming an end wall, and means protruding from the channel members of an adjacent side wall panel for connecting said end wall thereto, said means for connecting said end wall including a plurality of spaced apart brackets protruding from the channel member of the adjacent side wall panel, and means for securing said end wall to said brackets.

9. A building structure, comprising: a series of transverse sections aligned end to end to form the side walls and roof of the building structure, each transverse section including a pair of roof panels pivotally connected together to form a roof, a pair of side wall panels respectively connected pivotally to and depending from said roof panels, means for holding said roof panels in fixed angular relation with respect to each other and with respect to said side wall panels, outwardly facing channel members extending along the end edges of said side wall and roof panels, means protruding from said channel members for connecting said transverse sections end to end, means forming an end wall, and means protruding from the channel members of the adjacent side wall panels and overlying roof panels for connecting said end wall thereto, said means for connecting said end wall including a plurality of spaced apart brackets protruding from the respective channel members, and means for securing said end wall to said brackets.

* * * * *